United States Patent [19]

Shannon

[11] 4,274,557

[45] Jun. 23, 1981

[54] BEVERAGE DISPENSER PUMPING SYSTEM

[75] Inventor: Joseph W. Shannon, Kent, Ohio

[73] Assignee: American Beverage Control, Mogadore, Ohio

[21] Appl. No.: 742,693

[22] Filed: Nov. 17, 1976

[51] Int. Cl.[3] ..... B67D 5/56

[52] U.S. Cl. ..... 222/136; 222/145; 222/372; 137/513.7

[58] Field of Search ..... 222/136, 145, 571, 129.4, 222/476, 70, 477, 146, 372; 137/513.7; 141/116

[56] References Cited

U.S. PATENT DOCUMENTS

| | | | |
|---|---|---|---|
| 2,845,089 | 7/1958 | Nickols | 137/513.7 X |
| 3,378,170 | 4/1968 | Reynolds et al. | 222/129.4 |
| 3,511,468 | 5/1970 | Young | 222/571 X |
| 3,727,799 | 4/1973 | Nixon | 222/129.4 |
| 3,865,276 | 2/1975 | Thompson | 222/146 C |
| 3,886,974 | 6/1975 | Bjorklund | 141/116 X |
| 3,896,972 | 7/1975 | Neidore et al. | 222/136 |

*Primary Examiner*—David A. Scherbel

*Attorney, Agent, or Firm*—Oldham, Oldham, Hudak & Weber Co.

[57] ABSTRACT

A beverage dispenser pumping system having a mass reservoir for receiving a plurality of beverage-containing bottles in such manner that all of the bottles feed a common line but no intercommunication of beverages among the bottles is possible. The mass reservoir feeds a pessurized pump which is operative for driving an expandable and contractable dispensing line. A dispensing valve is located near the end of the dispensing line for initiating and terminating the flow of beverage from the pump, through the line and out of a dispensing head. A one-way valve interposed within the dispensing line and closely adjacent the pump retains liquid pressure within the line and inhibits any bleeding of beverage from the line back into the pump when dispensing has terminated. A hydraulic accumulator is presented between the dispensing valve and the dispensing head to withdraw beverage from the end of the dispensing line when the dispensing valve shuts off so as to prohibit extraneous drippage from the line. This element further eliminates liquid bounce due to line contortions by isolating the major portion of the line from that portion which is nearest the dispensing head.

10 Claims, 8 Drawing Figures

BEVERAGE DISPENSER PUMPING SYSTEM

BACKGROUND OF THE INVENTION

In recent years the art of dispensing beverages, both mixed drinks and those comprised of a single component, has advanced to the point where either preprogrammed or operator-concocted drinks may be dispensed via a single pouring head from beverage containers located remote from the pouring head. While the convenience, speed, accuracy and security associated with such systems have made the same extremely attractive on the market place, certain inherent problems have been encountered with the pumping systems necessary to maintain beverages within reservoirs and deliver such beverages to a remote dispensing head under control of an operator. Particularly, state and federal regulations require that beverages be dispensed from the bottle in which they are purchased and that no intermingling of beverages between and within bottles occur. Yet further, dripping of beverages at the dispensing head results in a diminution of taste for any drinks into which such drippage falls and further results in a loss of beverage as well as a shortage on the amount of that beverage dispensed in an immediately subsequent dispersal. Yet a further problem associated with such beverage dispensing systems is the void and vacuums which will often times present themselves in a dispensing line if the line is of excessive length or if the line substantially changes elevation from the pumping system to the dispensing head. Similar problems occur when ambient temperature changes of the dispensing line effect volatile liquids therein causing expansion, contraction, and vaporization of the same with resultant separation of the fluid within the lines.

Consequently, it is an object of the instant invention to present a beverage dispenser pumping system which includes a reservoir assembly wherein dispensing of the beverages is from the bottles themselves and wherein a plurality of identical bottles may feed a central pump with no interflow of fluid occurring between the various bottles.

Another object of the invention is to present a beverage dispenser pumping system wherein a hydraulic accumulator is interconnected near the end of each dispensing line to draw liquid back from the end of the line at the end of each dispersal so as to alleviate drippage.

Yet a further object of the invention is to present a beverage dispenser pumping system which includes the aforesaid hydraulic accumulator and wherein such accumulator is free of springs, diaphragms or other biasing means heretofore required in the art.

Still another object of the invention is to present a beverage dispenser pumping system which includes a unique valve assembly connected in the line near the pump and actuated by the cessation of flow within the line so as to pressurize and seal the line from the pump.

A further object of the invention is to present a beverage dispenser pumping system which is reliable and endurable in operation, while being relatively simplictic in construction and function.

These objects and other objects which will become apparent as the detailed description proceeds are achieved by apparatus for dispensing liquids from a plurality of containers, comprising: first means in communication with the plurality of containers for receiving and maintaining the liquids; a pump connected to the first means and receiving liquid therefrom; a dispensing line having an open dispensing end; first valve means interconnected between the pump and the dispensing line for inhibiting fluid flow from the line to the pump; second valve means interposed within the dispensing line for initiating and terminating the flow of liquid from the pump and out the open dispensing end; and third valve means within the dispensing line between the dispensing end and the second valve means for drawing liquid from the dispensing end toward the second valve means upon termination of flow.

DESCRIPTION OF THE DRAWINGS

For a complete understanding of the objects, techniques and structure of the invention, reference should be had to the following detailed description and accompanying drawings wherein.

DETAILED DESCRIPTION OF THE PREFERRED EMBODIMENT

Figure 1:
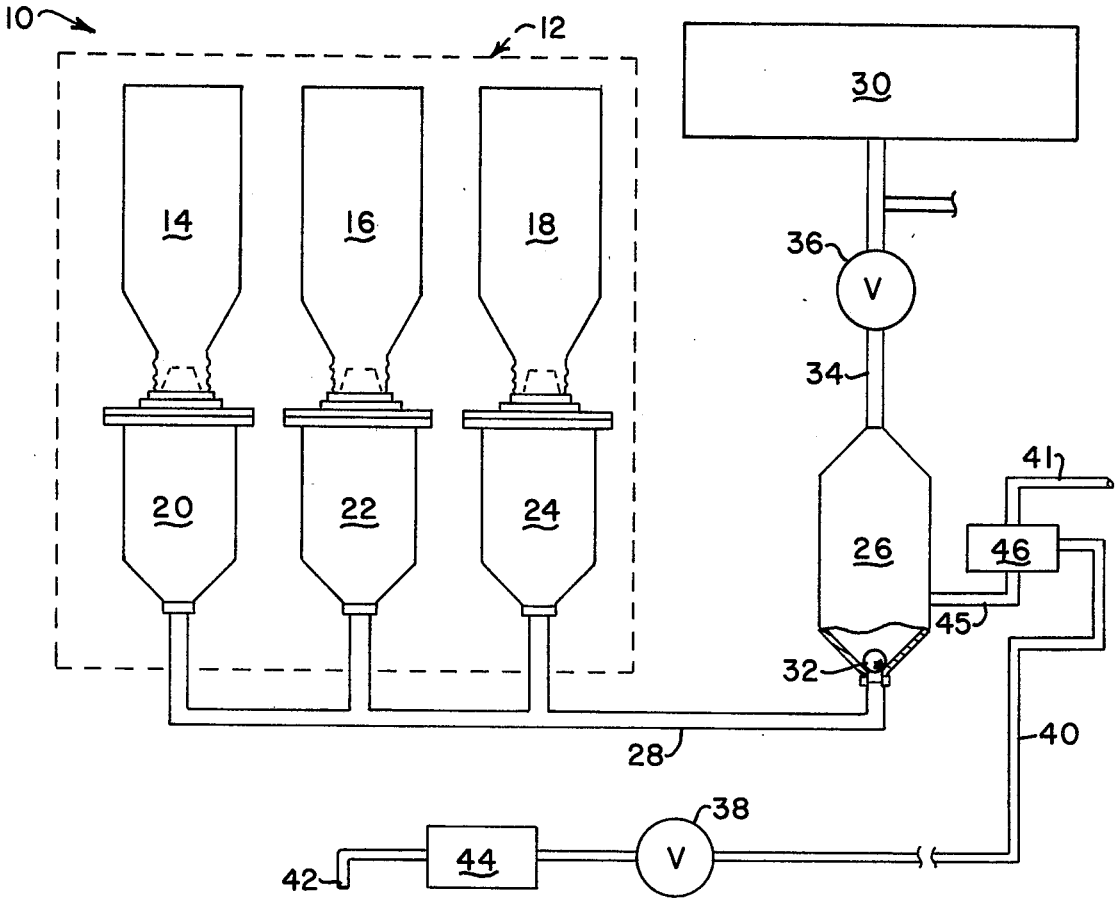
FIG. 1 is a functional system diagram of the invention.

Referring now to the drawings and more particularly FIG. 1, it can be seen that the beverage dispenser pumping system of the invention is designated generally by the numeral 10. The system includes a reservoir 12 comprising a plurality of bottles 14–18 feeding a similar plurality of containers 20–24. The bottles 14–18 may be the same bottles in which the beverages are purchased. The containers 20–24 are interconnected with a pump 26 by means of a conduit 28. While for purposes of the instant invention the pump 26 may be of any suitable nature, it is preferred that the pump be of a similar structure to the pump presented in U.S. Pat. No. 3,991,911, assigned to American Beverage Control Corporation of Kent, Ohio. Similarly, the mating of the bottles 14–18 with respective containers 20–24 is set forth in the recited patent. Communication between the containers 20–24 and the pump 26 is controlled by gravity feed through the one-way valve comprising the steel ball 32. Pressure from the compressor 30 is applied to the pump 26 via the conduit 34 upon actuation of an air valve 36 which is controlled by electronic controls associated with the dispensing system. It should of course be readily appreciated that the liquid within the pump 26 and/or the conduit 34 will seek a level determined by the relative positioning of the pump with respect to the reservoir 12.

In the system described in the aforementioned patent, the actuation of a pour switch at the head of the dispensing system enables the solenoid dispensing valve 38 to allow beverage to flow from the pump 36, through the line 40, and out the dispensing head 42. The beverage flows for a programmed time interval until the valve 38 is closed. Immediately upon the closing of the valve 38 an hydraulic accumulator 44 operates in a manner to be discussed hereinafter to draw the liquid back from the head 42 so as to prevent further flow of the beverage or subsequent dripping thereof.

At the opposite end of the line 40 from the hydraulic accumulator 44 is a one-way check valve 46, the details of which will be discussed hereinafter. Upon termination of flow by the closing of the valve 38, the check valve 46 is closed thus inhibiting flow from the line 40 back into the pump 26. Thus, there is retained within the line 40 a constant volume of fluid which, as will become apparent, is maintained under pressure.

Figure 2:
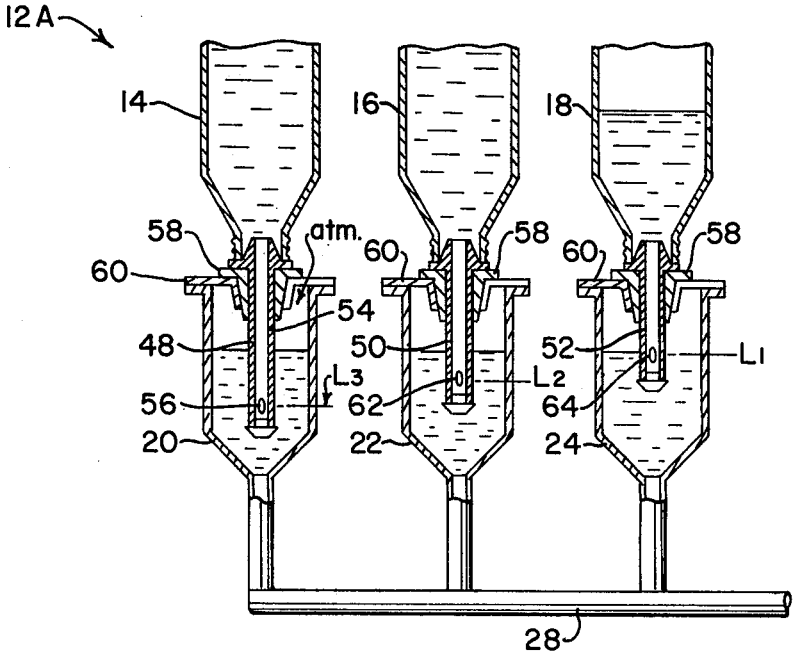
FIG. 2 is a cross-sectional view of one embodiment of the reservoir system of FIG. 1.

With reference now to FIG. 2, there can be seen an embodiment of the reservoir 12, designated generally by 12A. Again, bottles 14–18 are interconnected with containers 20–24 in a manner set forth in the aforementioned patent. Each of the containers 20–24 communicates with the conduit 28 via appropriate tubing and the like. Since state and federal regulations require that no communication of beverage be made between and among the various bottles 14–18, a unique arrangement and positioning of the various bottle adaptors 48–52 or the containers 20–24 may be utilized to achieve the desired results. While the specifics of the bottle adaptors 48–52 is clearly set forth in the aforementioned patent, it should be noted that the same generally include a tubular member 54 having openings 56, 56 therein. The tubular member 54 is snugly received within the neck of the bottle 14 and an adaptor sleeve 58 makes engagement with a container head sleeve 60 to maintain the bottle in the appropriate position. Fluid may then flow from the bottle 14 through the tubular member 54 and out the openings 56, 56 into the interior of the container 20. Of course, similar arrangement is made for the bottle-container assemblies 16, 22 and 18, 24. It should be noted that an air vent may be presented in the container head sleeve 60 to prevent the creation of a vacuum within the container or the sleeves 58, 60 may be made to fit loosely enough that atmospheric communication into the interior of the container 20 is possible.

The adaptors 48–52 are provided in one embodiment of the invention of different lengths with the adaptor 48 being of greatest length and the adaptor 52 of the shortest length. Thus, the adaptor 48 depends into the container 20 the greatest distance while the adaptor 52 depends into the container 24 the least distance. When the system is sitting statically after the insertion of new bottles of liquid 14–18, the containers 20–24 within the system will fill to the level L1 defined by the openings 64, 64 of the adaptor 52. As dispersals are made via the system of FIG. 1 from the reservoir 12*a* to the pump 26 and subsequently through the line 40 and head 42, replenishment of the liquid dispensed will be made from bottle 18 since the openings 56, 62 are sealed by beverage and the dropping of the level L1 by the dispersal exposes only the openings 64, 64 for replenishment. It should be readily appreciated that this process will continue until the entire supply of beverage within the bottle 18 is exhausted. At that time, the new level within the containers 20–24 will be at L2 as defined by the openings 62, 62. The same type of dispensing will occur as was presented with respect to bottle 18 until the supply in bottle 16 is exhausted; the bottle 14 retaining its beverage because of the level L2 being above the openings 56, 56 and maintaining the bottle 14 in a substantially sealed posture. Of course, when the bottle 16 has been completely dispensed, the new level within the containers 20–24 will be L3 as defined by the openings 56, 56. Thus, the dispensing of beverages is achieved from one bottle at a time with no intercommunication among the bottles.

Figure 3:
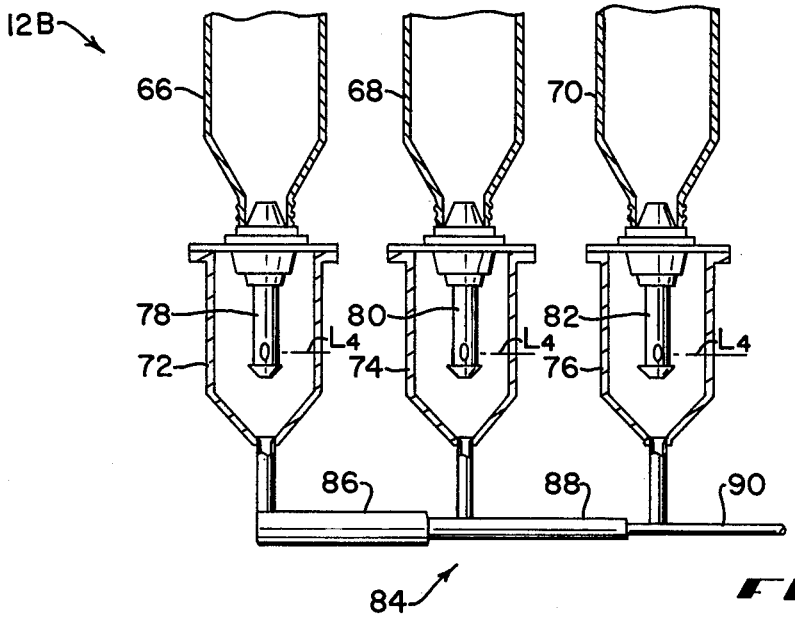
FIG. 3 is a cross-sectional view of another embodiment of the reservoir system of FIG. 1.

A second embodiment of the dispensing reservoir 12 as shown in FIG. 1 is presented in FIG. 3 and designated generally by the numeral 12B. Again, a plurality of bottles 66–70 are respectively received within containers 72–76 and have bottle adaptors 78–82 depending thereinto. The bottles 66–70 and containers 72–76 are identical in nature to those shown in FIG. 2. Similarly, the bottle adaptors 78–82 are identical to those shown in FIG. 2 but for the fact that all of the bottle adaptors 78–82 are of identical length. Consequently, the openings of the respective adaptors depend into the containers identical depths such that the beverage within the system will fill to a level L4. The various containers 72–76 communicate with the pump 26 by means of a conduit 84 which is made up of a number of sections equivalent to the number of containers utilized, the sections decreasing in diameter toward the pump assembly 26. Thus, the section 86 is of a larger diameter than the section 88 which is in turn of a larger diameter than the smallest element 90.

Two principles govern the operation of the system 12B. First, the Bernouli principle dictates that flow within the tube 84 results in the lowest pressure during flow being evidenced in the smallest diameter tube 90 such that the least restriction to fluid flow is present for the fluid within the container 76. Hence, dispersals are made from the container 76 while simultaneously being refilled by fluid contained in bottle 70. Further, the element 90 being closest to the pump 26, provides the least restrictive path for fluid flow to the pump. Once the bottle 70 has emptied, the least restrictive path within the system is from the bottle 68 and through the next larger tube 88. Similarly, with the exhausting of the fluid contained within the bottle 68, the last bottle 66 dispenses through the largest tubular member 86. The fluid path restrictions resulting in sequential depletion of the bottles 66–70 is a result not only of the proximity of the bottles to the pump, but also the abrupt changes of tube diameters at the point of interconnection of the tube sections 86–90. It has been noted in utilizing the system that the bottles deplete themselves progressively with the bottle 70 being completely exhausted with only minimum depletion of the bottle 68 and similarly, the bottle 68 is exhausted with only minimum depletion of the bottle 66. However, until the bottle 66 is completely exhausted, the levels within the containers 72–76 remain at the level L4 defined by the openings since the beverage tends to seek its own level.

Thus it can be seen that two separate and distinct reservoirs 12A, 12B may be utilized in achieving the objects of the instant invention to restrict and inhibit communication of fluid among the various bottles.

Figure 4:
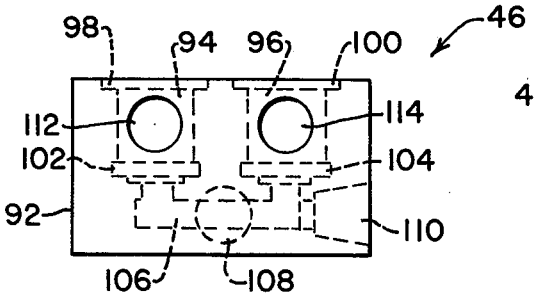
FIG. 4 is a front plan view of the line sealing or check valve of the system.
Figure 5:
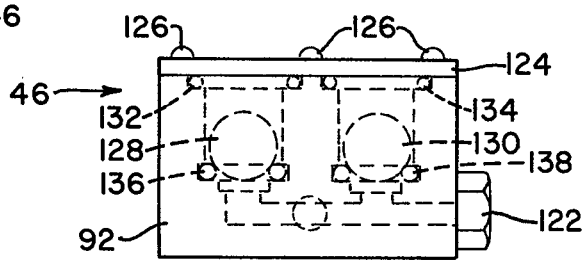
FIG. 5 is a front plan view of the assembled structure of FIG. 4.
Figure 6:
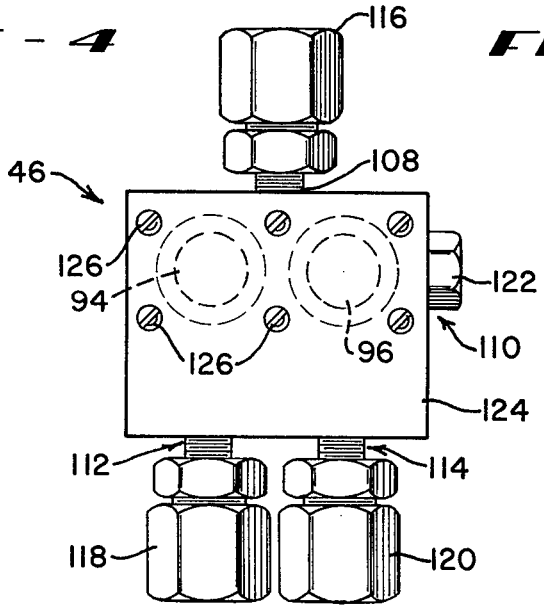
FIG. 6 is a top plan view of the assembled structure of FIG. 4 having the inlet and outlet couplings connected thereto.

With reference now to FIGS. 4–6, it can be seen that the check valve 46 consists of a housing 92 which may be of any suitable construction but is preferably of a plastic material. Indeed, the valve 46 may be constructed from a solid block of plastic by appropriately drilling, counter-sinking, and plugging. Contained within the housing 92 are cylindrical chambers 94, 96 having counter bores 98, 100 at the top thereof and counter bores 102, 104 at the bottom thereof. As should be apparent, the number of chambers 94, 96 is dependent on the number of dispensing stations to be serviced by the dispensing system. A channel 106 is in communication with the chambers 94, 96 and in further communication with the line 45 from the pump assembly 26 (as shown in FIG. 1) via an inlet 108 preferably connected to the center of the channel 106. It should be readily appreciated that the channel 106 may be created in the block 92 by drilling through one end of the block and subsequently sealing or plugging the end as at 110. Outlets 112, 114 are in further communication with the chambers 94, 96 and may be connected to the lines 40, 41 as shown in FIG. 1. Appropriate connectors 116–120 are connected to the appropriate inlets and outlets 108, 112, 114 to achieve the desired communication. A plug 122 may be used for sealing the opening 110 by which the channel 106 was created. A cover 124, again preferably of plastic construction, is secured over the top of the housing 92 by means of screws or other fasteners 126. Sealing engagement is made from O-rings 132, 134 in the top counter bores 98, 100 for fluid tight engagement with the cover 124. Similarly, O-rings 136, 138 are retained within the bottom counter bores 102, 104 to provide valve seats for stainless steel balls 128, 130 received within the chambers.

With reference now to FIG. 1, an understanding of the operation of the check valve 46 may be had. In the preferred embodiment of the invention the dispensing lines 40, 41 are of an expandable and flexible nature such that with the pump 26 pressurized and the dispensing valve 38 opened, pressurized beverage is forced through the line 40 and out the dispensing head 42 with the line 40 being caused to expand from pressure within the dispensing pump. Of course, during the dispensing period, beverage leaves the pump 26, passes through the line 45, enters the inlet 108, and is passed through the chamber or chambers 94, 96 which are in communication with a line 40, 41 having an open dispensing valve. The passing of beverage through the chamber lifts the associated stainless steel ball 128, 130 from its seated engagement with the related O-ring 136, 138 to allow the beverage to pass. When the valve 38 is closed, terminating the dispensing cycle, the flow of beverage from the pump 26 continues for an incremental portion of time expanding the tube 40. The lifted stainless steel ball 128, 130, being of a greater density then the beverage, falls onto the associated O-ring 136, 138 and the back pressure exerted by the line 40, in an attempt to contract, holds the ball in sealing engagement. Consequently, the line 40 or 41 stays pressurized with a fixed amount of fluid therein and the check valve 46 inhibits the flow of any of the beverage back into the pump 26 which is now depressurized. This is a very beneficial aspect of the system, expecially for lines through which there is dispensed liqueurs or other such beverages which have a tendency to separate, expand or contract with temperature variations, since the check valve 46 prohibits or restricts such activity. Further, when the lines 40, 41 are provided in an installation wherein the same must experience vertical maintenance, the provision of the check valve 46 is important to guarantee that the beverage within the line does not separate, vaporize, or otherwise bleed back into the pump 26 and allow air pockets or the like to become present in the line. No known dispensing systems provide for the combination of a dispensing line having a memory (being expandable and contractable) and having a check valve immediately at the pumping station.

Figure 7:
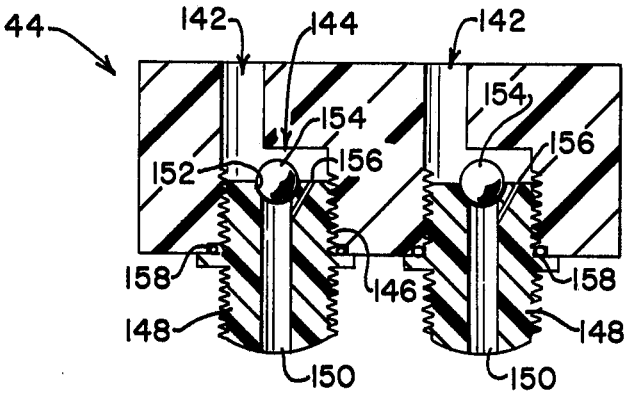
FIG. 7 is a cross-sectional view of the hydraulic accumulator of the system.
Figure 8:
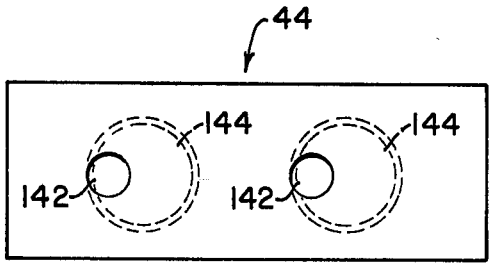
FIG. 8 is a top plan view of the hydraulic accumulator of FIG. 7.

With reference to FIGS. 7 and 8, there is shown a hydraulic accumulator 44 according to the teachings of the invention. While the structure herein described and shown comprises a two-unit hydraulic accumulator, operative for servicing two dispensing lines, the basic teachings of the invention are applicable to a single-unit hydraulic accumulator and may be expanded to serve any number of dispensing lines. The housing 140, which is of any suitable structure but preferably a plastic composition, contains a bore 142 drilled therethrough and counter sunk for purposes of receiving a fitting such as that utilized in the check valve 46 described hereinabove. A second bore 144, of larger diameter, is similarly drilled into the housing 140 from the opposite side of the bore 142 such that the two bores are tangent on one side thereof. The bore 144 is threaded about the circumference thereof as at 146 and is operative for receiving a plastic or other suitable fitting 148 sealed against O-rings 158. The fitting 148 has a passageway 150 centrally passing therethrough which is operative for allowing communication between the bore 142 and the dispensing line passing from the valve 38 to which the fitting is secured. The opening of the passage 150 within the chamber 144 defines a seat 152 upon which may rest a stainless steel ball 154 in valve-closing engagement. Of particular importance to the teachings of the hydraulic accumulator 44, is the presence of a small diameter passageway 156 communicating between the passageway 150 and the bore 144. Even with the stainless steel ball 154 in sealing engagement with the seal 152, communication may be had between the passageway 150 and the bore 144 via the small diameter orifice 156; the particular importance of which will become apparent directly hereinafter.

With reference now to FIG. 1 and with particular concern for the structure of FIGS. 7 and 8, it can be seen that the hydraulic accumulator 44 is operative for preventing dripping of dispensable beverages and for guaranteeing a snap-off effect at the dispensing head when dispensing is terminated via the valves 38. It should now be understood that beverage is dispensed via the open valve 38 and through the passageway 150 thus lifting the ball valve 154 from the seat 152 and allowing the beverage to pass to the dispensing head 42. When the valve 38 snaps shut, the flow of beverage continues for an incremental time duration until all of the energy or momentum of the fluid moving through the dispensing line contracts due to a slight vacuum in the line created by the continued flow subsequent to valve closing. Due to the differences in specific gravity between the beverage and the ball, the stainless steel ball 154 falls into sealing engagement with the seat 152. At this time, the contracted line between the valve 38 and the accumulator 44 resiliently expands to achieve a quiescent condition, and in so expanding, creates a suction through the passage 150, small diameter passageway 156, bores 144, 142, and the end of the line of the dispensing head 42. This metered withdrawal of fluid causes a concave surface on the fluid at the end of the line 42 a short distance of approximately a quarter of an inch up within the tube. Surface tension and the quiescent state of the line between the valve 38 and accumulator 44 maintains the concave character of the recessed fluid tip until a subsequent dispersal is made.

Thus it can be seen that the objects of the invention have been satisfied by the structure and techniques presented hereinabove. While in accordance with the patent statutes only the best mode and preferred embodiments of the invention have been presented and described in detail, it is to be understood that the invention is not limited thereto or thereby. Consequently, for an appreciation of the scope and breadth of the invention, reference should be had to the appended claims.

What is claimed is:

1. Apparatus for dispensing fluids out of a pouring head, comprising:

a dispensing line terminating at one end thereof at the pouring head;

pump means connected to another end of the dispensing line for forcing fluids through said line;

first valve means in said line for enabling the flow of fluid from said pump means, through said line, and out of the pouring head when open at the beginning of a dispensing cycle and prohibiting such flow when closed at the end of a dispensing cycle; and second valve means in said line between the pouring head and said first valve means for enabling the flow of fluid through said line and out of the pouring head when said first valve means is open and allowing the fluid within said line to withdraw from the pouring head when said first valve means closes at the end of a dispensing cycle, said dispensing line being elastically expandable and contractable between said first and second valve means, said second valve means comprising:

an inlet port in communication with said line from the first valve means;

an outlet port in communication with said line to the dispensing head;

a chamber interconnecting said inlet and outlet ports; and a sealing ball engageable with a seat at the point of interconnection of the inlet port and chamber.

2. The apparatus as recited in claim 1 wherein a small diameter passageway is present in continual open communication between the inlet port and chamber, said passageway bypassing said ball and seat engagement.

3. The apparatus as recited in claim 2 wherein said inlet port consists of a tubular fitting received within said chamber, said passageway passing through a wall of said fitting.

4. The apparatus as recited in claim 3 wherein an end of said tubular fitting received within said chamber defines said seat.

5. Apparatus for dispensing fluids from their original containers and out of a pouring head, comprising:

pump means for receiving and forcing the beverages toward the pouring head;

reservoir means connected to said pump means for receiving a plurality of the original containers and maintaining the beverages therefrom in common communication with said pump means while restricting intercommunication of the beverages within the containers;

an elastically expandable and contractable dispensing line interconnected between said pump means and the pouring head;

first valve means interposed in said line for enabling the flow of beverages from the pouring head when open at the beginning of a dispensing cycle and prohibiting such flow when closed at the end of such cycle;

second valve means interposed in said line between said pump means and first valve means for prohibiting the flow of beverage from said line and into said pump means, and wherein said second valve means closes after the closing of said first valve means following a dispensing cycle, closing of said second valve means maintaining beverage under pressure within said dispensing line between said first and second valve means; and third valve means interposed in said line between said first valve means and the pouring head for enabling the flow of beverage through said line and out of the pouring head when said first valve means is open and allowing the beverage in said line to slowly withdraw from the pouring head when said first valve means restricts the flow of beverages from the pouring head.

6. The apparatus as recited in claim 5 wherein said second valve means comprises:

a chamber;

an inlet port in communication between said chamber and said pump means;

an outlet port in communication between said chamber and dispensing line; and a ball and seat valve within said chamber and maintained at the point of interconnection of said inlet port and chamber.

7. The apparatus as recited in claim 5 wherein said third valve means comprises:

an inlet port in communication with said dispensing line from said first valve means;

an outlet port in communication with said dispensing line to the dispensing head;

a chamber interconnecting said inlet and outlet ports; and a ball and seat valve maintained with said chamber.

8. The apparatus as recited in claim 7 wherein a small diameter passageway is present in open communication between said inlet port and chamber for bypassing said ball and seat valve.

9. A beverage dispenser pumping system for dispensing beverages from their original containers and out of a pouring head, comprising:

pump means for receiving and forcing the beverages toward the pouring head;

a plurality of receptacles, each in beverage receiving communication with one of the original containers and in common communication, along with all other receptacles along a common flowpath, with said pump means; and an adapter having an orifice therein interconnected between each of the containers and said associated receptacles, communication between the containers and receptacles being through said orifice, the orifice of each of the various adapters being maintained at a different vertical level from the orifice of all other adapters, the vertical position of each orifice being directly related to the position of the associated receptacle to the pump means along said common flowpath such that the orifice communicating with the receptacle nearest the pump means is of the highest elevation and that furthest from the pump means is of the lowest elevation.

10. A beverage dispenser pumping system for dispensing beverages from their original containers and out of a pouring head, comprising:

pump means for receiving and forcing said beverages toward the pouring head;

a plurality of receptacles, each in beverage receiving communication with a separate one of the original containers and in common communication, along with all other receptacles, with said pump means;

a plurality of adapters, each having an orifice therein, one interconnected between each of the containers and said associated receptacle, communication between the containers and receptacles being through said orifice; and wherein each of said receptacles communicates with the other receptacles and with the pump means via a line of a plurality of sections, each section of a different diameter, and wherein one receptacle is interconnected with each section, the receptacle closest to the pump means being connected to the smallest diameter section, and the remaining receptacles being progressively connected to increasingly larger diameter sections such that the receptacle furthest along the line from said pump means is connected to the largest diameter section.

* * * * *